United States Patent [19]

Bhatia

[11] Patent Number: 4,839,082

[45] Date of Patent: Jun. 13, 1989

[54] CONTACT LENS CLEANING COMPOSITIONS CONTAINING A CARBOXY VINYL POLYMER

[75] Inventor: Rajkumar P. Bhatia, Arlington, Tex.

[73] Assignee: Alcon Laboratories, Inc., Fort Worth, Tex.

[21] Appl. No.: 229,766

[22] Filed: Aug. 4, 1988

Related U.S. Application Data

[63] Continuation of Ser. No. 946,343, Dec. 24, 1986, abandoned.

[51] Int. Cl.[4] ..... C11D 3/14

[52] U.S. Cl. ..... 252/174.12; 252/174.23; 252/174.24; 252/174.25; 252/DIG. 2; 134/7; 134/42

[58] Field of Search ..... 252/174.12, DIG. 2, 252/174.23, 174.24, 174.25

[56] References Cited

U.S. PATENT DOCUMENTS

| | | | |
|---|---|---|---|
| 3,882,036 | 5/1975 | Krezanoski et al. | 252/106 |
| 3,910,296 | 10/1975 | Karageozian et al. | 134/2 |
| 3,954,644 | 5/1976 | Krezanoski et al. | 252/106 |
| 3,954,965 | 5/1976 | Boghosian et al. | 424/81 |
| 4,046,706 | 9/1977 | Krezanoski | 252/106 |
| 4,096,870 | 6/1978 | Manfuso, Jr. | 134/28 |
| 4,127,423 | 11/1978 | Rankin | 134/30 |
| 4,357,173 | 11/1982 | Rosenthal et al. | 134/6 |
| 4,394,179 | 7/1983 | Ellis et al. | 134/7 |
| 4,421,665 | 12/1983 | Lloyd et al. | 252/106 |
| 4,440,662 | 4/1984 | Tsuzuki et al. | 252/106 |
| 4,493,783 | 1/1985 | Su et al. | 252/174.23 |
| 4,500,441 | 2/1985 | Tanaka et al. | 252/89.1 |
| 4,504,405 | 3/1985 | Howes | 252/106 |
| 4,521,254 | 6/1985 | Anderson et al. | 134/26 |
| 4,533,399 | 8/1985 | Mencke | 134/6 |
| 4,534,878 | 8/1985 | Ellis et al. | 252/173 |
| 4,588,444 | 5/1986 | Anderson | 134/2 |
| 4,599,195 | 7/1986 | Schafer et al. | 252/546 |
| 4,609,493 | 9/1986 | Schafer | 252/546 |
| 4,613,379 | 9/1986 | Su et al. | 134/7 |

*Primary Examiner*—John F. Niebling
*Assistant Examiner*—Isabelle Rodriguez
*Attorney, Agent, or Firm*—James A. Arno; Gregg C. Brown

[57] ABSTRACT

Contact lens cleaning compositions containing a carboxy vinyl polymer, and a method of cleaning contact lenses with such compositions are descrived. The compositions are capable of cleaning soiled contact lenses very rapidly and completely due to the cleaning action of an abrasive precipitate formed by the carboxy vinyl polymer component when a small amount of compositions is rubbed on the lenses.

2 Claims, No Drawings

CONTACT LENS CLEANING COMPOSITIONS CONTAINING A CARBOXY VINYL POLYMER

This is a continuation, of application Ser. No. 946,343, filed Dec. 24, 1986 now abandoned.

BACKGROUND OF THE INVENTION

1. Field of the Invention

The present invention relates to the field of contact lens care. More particularly, this invention relates to compositions for cleaning contact lenses which comprise a carboxy vinyl polymer which forms an abrasive precipitate when the compositions are rubbed on contact lenses.

2. Discussion of Related Art

The cleaning of human-worn contact lenses is a problem which has been addressed in numerous prior art patents and other publications. Many of the previous attempts to solve this problem have focused on the use of particular types of surfactants; the following patents represent examples of such attempts: U.S. Pat. Nos. 3,882,036; 3,954,644; 4,046,706; and 4,599,195. The use of enzymes has also been proposed as a solution to this problem; U.S. Pat. Nos. 3,910,296; 3,954,965; 4,096,870; 4,521,254; and 4,609,493 describe this approach. A relatively recent approach addressing the cleaning problem utilizes polymeric particles as an abrasive material to physically remove deposits from the surface of the lens; this approach, which has been relatively successful, is described in U.S. Pat. No. 4,493,783. U.S. Pat. Nos. 4,394,179 and 4,534,878 describe approaches wherein inorganic abrasive materials are utilized. U.S. Pat. No. 4,533,399 describes the use of a fibrous web to clean contact lenses.

There have been numerous other attempts to solve the cleaning problem in addition to those cited above. The following U.S. Pats. may be referred to for additional background information in this regard: U.S. Pat. Nos. 4,127,423; 4,357,173; 4,421,665; 4,440,662; 4,500,441; and 4,504,405.

A new approach to the cleaning problem is described in the copending and commonly assigned application of Van Duzee titled "CONTACT LENS CLEANING PRODUCT AND METHOD OF USE." This approach is based on the use of a nonwoven web impregnated with an enzyme to clean contact lenses.

Another new approach is described in the copending and commonly assigned application of Bhatia, et al., titled "CONTACT LENS CLEANING COMPOSITION AND METHOD OF USE." This approach is based on the use of compositions comprising an enzyme and an abrasive particulate material to clean contact lenses.

Yet another new approach is described in applicant's copending and commonly assigned application titled "CONTACT LENS CLEANING COMPOSITIONS CONTAINING AN ENZYME AND A CARBOXY VINYL POLYMER." This approach is similar to the approach taken in the present invention, but differs in that it is based on the use of a carboxy vinyl polymer in combination with an enzyme.

SUMMARY OF THE INVENTION

A principal object of the present invention is the provision of compositions capable of rapidly and completely removing deposits of proteins, lipids, and other materials from contact lenses. A further object of this invention is the provision of a method of cleaning contact lenses using such compositions.

The foregoing objects and other general objectives of the present invention are achieved by the provision of contact lens cleaning compositions which comprise a carboxy vinyl polymer which is dissolved in the compositions, but forms an abrasive precipitate when rubbed on a contact lens, thereby facilitating physical removal of such deposits; and a suitable carrier for the carboxy vinyl polymer. It has been discovered that such compositions are capable of removing deposits of proteins, lipids, and other materials from the surfaces of contact lenses in a very efficacious manner.

DESCRIPTION OF PREFERRED EMBODIMENTS

The compositions of the present invention contain an amount of a carboxy vinyl polymer sufficient to substantially reduce all deposits present on the surfaces of a contact lens by forming an abrasive precipitate when rubbed on the surface of the lens, thereby facilitating physical removal of such deposits. The precipitate formed by the carboxy vinyl polymer component of the present compositions is particularly effective in removing loosely bound deposits from the surfaces of a lens, such as deposits of debris (e.g., lint) and cosmetic residues, as well as large deposits of proteins, lipids, and other materials.

The carboxy vinyl polymers are contained in the present compositions in solubilized form. The mechanism by which these polymers form an abrasive precipitate when the compositions are rubbed on contact lenses is not completely understood at this time. It is believed that this precipitate is the result of water loss which occurs immediately when a few drops of the compositions are rubbed on a contact lens. This water loss results from a portion of the water in the compositions being taken up by the contact lens being treated, a portion of the water evaporating, and a generalized loss of the solubilizing effect of the water in the compositions as the compositions are spread out in a thin film when rubbed on contact lenses. This loss of water causes at least a portion of the carboxy vinyl polymer in the composition to come out of solution or "precipitate." The thus formed precipitate has been found to be very effective as an abrasive material in the cleaning of contact lenses, and may be used very advantageously for this purpose, because of the ease with which it can be removed from the lens after completion of cleaning by merely rinsing the lens to resolubilize the precipitated carboxy vinyl polymer.

The carboxy vinyl polymers which may be utilized in the present invention have a molecular weight of from about 1,000,000 to about 6,000,000. The polymers have carboxylic functional groups, and preferably contain 2 to 7 carbon atoms per functional group. These polymers include the carboxypolymethylene polymers available from the B. F. Goodrich Company under the name CARBOPOL.

The amount of carboxy vinyl polymer contained in the present compositions will vary depending on factors such as the particular type of carboxy vinyl polymer utilized, the type of contact lens being treated (e.g. "hard" or "soft") and the cleaning regimen being employed. The compositions of the present invention will typically contain from about 0.5% to about 25% by weight of one or more carboxy vinyl polymers.

The compositions of the present invention further comprise a carrier which is compatible with both ocular tissue and the other components of the compositions, including the carboxy vinyl polymer(s) contained therein. Carriers which meet these requirements are referred to herein as being "ophthalmically acceptable." The carrier will typically be aqueous, and may include a thickening agent, such as various celluloses known for such use in the art (e.g., cellulose, hydroxyethylcellulose, and methoxy cellulose); polyethylene glycol with a molecular weight distribution of about 400 to about 4,000; low molecular weight hydroxyethylmethacrylate; polyvinyl alcohol; polyvinylpyrrolidone; polysaccharide gums (e.g., xanthan gum) and mixtures thereof.

The compositions may optionally further comprise one or more surfactants, preservatives, chelating agents, tonicity agents or antistatic agents. These types of ingredients are well known in the art. An exhaustive listing of illustrative examples of these ingredients is therefore believed to be both unnecessary and inappropriate. Representative examples of these types of ingredients include: surfactants such as polyoxyethylene/polyoxypropylene copolymers (e.g., PLURONIC 127); preservatives such as thimerosal, sorbic acid, POLYQUAD® (i.e., a polymeric germicide also known as ONAMER M, available from Onyx Chemical Co.), and benzalkonium chloride; chelating agents such as EDTA; tonicity agents such as sodium chloride and potassium chloride; and antistatic agents such as Foraperle B320 (available from Rilsan Corporation).

The present invention also concerns a method of cleaning contact lenses utilizing the above-described compositions. This method comprises applying a small amount of the composition (e.g., a few drops if in liquid form) to the surfaces of the lens and rubbing the composition over the surfaces of the lens for a short time, normally for 30 seconds or less. The thus cleaned lens is then rinsed with a suitable contact lens rinsing solution (e.g., saline solution) to remove the cleaning composition and debris from the surface of the lens. As mentioned above, rinsing of the lens results in rehydration and consequent dissolution of the abrasive precipitate formed by the carboxy vinyl polymer. The dissolution of this precipitate helps to ensure that no abrasive material remains on lenses subsequent to cleaning with the present compositions. The lens will normally be completely cleaned at this point. Prior to reinsertion in the eye, the cleaned lens will normally be disinfected using various known disinfection methods, such as soaking in a disinfectant solution containing one or more germicides.

EXAMPLE 1

This example further illustrates the formulation of compositions according to the present invention. This composition may be prepared as follows. Approximately 400 mL of the purified water is added to an aspirator bottle provided with appropriate attachments (e.g., 0.2 micron millipore filter, tubing, etc.). The CARBOPOL EX140 is then added to the purified water in the aspirator and mixed thoroughly. The set up is then steam sterilized at 121° C. under 15 lbs. pressure for 30 minutes, with continuous stirring until the solution has cooled. A second solution is then prepared by sequentially dissolving the sodium chloride, boric acid, edetate disodium, sodium borate and POLYQUAD® in approximately 500 mL of the purified water, and adjusting the pH of the resulting solution of 5.5. The second solution is then filtered into the first solution using a 0.2 micron millipore filter assembly and mixed thoroughly. The final volume is then adjusted to 1000 mL with the remaining purified water.

EXAMPLE 2

This example demonstrates the efficacy of the present compositions in cleaning soiled contact lenses.

Part I

A total of 12 clean contact lenses were treated with a solution of the following formula to simulate the deposits typically found on human worn contact lenses. Each of the lenses was placed in a vial containing 5 mL of this solution and heated for one hour at 92° C. The lenses were then removed from the containers and rinsed with saline to remove excess debris from the surfaces of the lens. The rinsed lenses were then again placed in vials and 5 mL of the deposition model solution (fresh) was added. The lenses were then again heated at 92° C. for one hour. Following this second heating cycle, the lenses were removed from the vials and washed with saline to remove excess debris. The rinsed lenses were then stored in saline. Part II The deposits on the lenses treated with the deposition model solution were then rated, based on the Rudko Lens Deposit Classification System. The criteria for this rating system are reproduced below.

The lenses were then individually treated with a composition identical to the one described in Example 1 above. The lens to be cleaned was held in the palm of the hand and two drops of the cleaning composition were placed on each side of the lens. The lens was then rubbed with a finger while remaining in the palm of the hand for approximately 20 seconds. The lens was then turned over and the opposite side thereof was rubbed in the same manner for approximately 20 seconds. The lens was then rinsed with saline to remove the cleaning composition and debris removed from the lens surfaces by the composition. The thus cleaned lenses were then examined and assigned a Rudko rating. Lenses which had not been completely cleaned (i.e., rating below I) were subjected to a second cleaning cycle, and where then re-examined and rated. The results of these experiments are set forth in Table 1 below.

What is claimed is:

1. A method of cleaning a contact lens which comprises:

applying to the lens a small amount of an aqueous contact lens cleaning composition consisting essentially of water and a carboxy vinyl polymer in an amount sufficient to facilitate physical removal of deposits and debris present on the lens, said carboxy vinyl polymer having a molecular weight of from about 1,000,000 to about 6,000,000;

rubbing the composition over the surface of the lens to form an abrasive precipitate of the carboxy vinyl polymer which polymer is present in an amount effective to substantially reduce deposits and debris present on the surface of the lens; and rinsing the lens to resolubilize the abrasive precipitate and remove the remaining composition and debris from the surface of the lens.

2. A method according to claim 1, wherein the carboxy vinyl polymer is contained in the composition in an amount of from about 0.5% to about 25% by weight.

* * * * *